United States Patent [19]

Shinoda et al.

[11] Patent Number: 4,505,240

[45] Date of Patent: Mar. 19, 1985

[54] FUEL INJECTION PUMP OF THE DISTRIBUTOR TYPE

[75] Inventors: Kazuo Shinoda, Toyota; Masahiko Miyaki, Oobu; Akira Masuda, Aichi; Hiroshi Koide, Okazaki, all of Japan

[73] Assignees: Toyota Jidosha Kabushiki Kaisha, Toyota; Nippondenso Co., Ltd., Kariya, both of Japan

[21] Appl. No.: 615,343

[22] Filed: May 30, 1984

[30] Foreign Application Priority Data

May 31, 1983 [JP] Japan ..... 58-96644

[51] Int. Cl.[3] ..... F02M 39/00

[52] U.S. Cl. ..... 123/357; 123/358; 123/458; 123/502; 123/506

[58] Field of Search ..... 123/357, 358, 458, 459, 123/502, 506

[56] References Cited

U.S. PATENT DOCUMENTS 4,036,193 7/1977 Kobayashi et al. ..... 123/357

FOREIGN PATENT DOCUMENTS 51-34936 9/1976 Japan .

*Primary Examiner*—Ronald H. Lazarus

*Attorney, Agent, or Firm*—Cushman, Darby & Cushman

[57] ABSTRACT

A fuel injection pump of the distribution type is provided with an electromagnetic valve for escaping the fuel in the pump chamber of the fuel injection pump. The fuel injection pump is also provided with a sensor for detecting the rotary angle of a pump shaft. This sensor is attached to a roller ring of a converter mechanism which also comprises a face cam, for example, and which also serves to convert the rotation of the pump shaft the reciprocate with that of a pump plunger. The sensor generates signals which represent the rotary angles of the pump shaft. The operation of the electromagnetic valve is controlled to escape the fuel in the pump chamber, depending upon the signals supplied from the sensor.

11 Claims, 6 Drawing Figures

FUEL INJECTION PUMP OF THE DISTRIBUTOR TYPE

BACKGROUND OF THE INVENTION

The present invention relates to a fuel injection pump of the distributor type for distributing and supplying fuel to the combustion chambers in an internal combustion engine, and more particularly, it relates to a fuel injection pump of the distributor type most suitable for use in diesel engines.

The distributive fuel injection pump of this type is disclosed in the Japanese Patent Publication No. Sho-51/34936. The fuel injection pump disclosed in this publication is provided with a fuel adjusting mechanism for adjusting the amount of fuel fed out of the pump. The fuel adjusting mechanism includes a fuel escaping passage which communicates with the pumping chamber in the fuel injection pump, and an electromagnetic valve for opening and closing the fuel escaping passage. The operation of this electromagnetic valve is controlled to open the fuel escaping passage after a predetermined delay time has elapsed since the fuel was pressurized in the pumping chamber. More specifically, the pressurized fuel which is to be fed from the pumping chamber into the combustion chamber of the engine is not fed from the pumping chamber into the combustion chamber, but escapes through the fuel escaping passage when the electromagnetic valve opens the fuel escaping passage, thereby enabling the amount of fuel fed by the fuel injection pump to be adjusted. In other words, the amount of fuel injected by the fuel injection pump can be controlled by the delay time starting from when the fuel is pressurized and ending when the electromagnetic valve is opened.

The mechanism for controlling the operation of the electromagnetic valve detects the rotary angle of the driving shaft of the fuel injection pump, the rotary angle corresponding to the time at which the fuel in the pumping chamber starts to be pressurized. It causes the electromagnetic valve to be opened after the predetermined delay time has elapsed since the start of the fuel pressurization.

In the fuel injection pump disclosed in the Japanese Patent Publication, however, the sensor for detecting the rotary angle of the driving shaft is fixedly located. When the fuel injection time adjusting means or timer arranged in the fuel injection pump, operates in accordance with the operation of the engine, therefore, the phase angle between the sensor around the axis of the driving shaft and the driving shaft itself is incorrect. In short, the phase angle is shifted from its correct one. As a result, the fuel pressure starting time obtained by detecting the rotary angle of the driving shaft by means of the sensor does not coincide with the actual fuel pressure starting time. This means that the delay time starting from the pressurizing of the fuel and ending in the opening of the electromagnetic valve is shifted from its desired value, thereby making it impossible to accurately control the amount of fuel injected by the fuel injection pump.

SUMMARY OF THE INVENTION

The object of the present invention is therefore to provide a fuel injection pump of the distributor type capable of controlling the amount of fuel injected with high accuracy, without exerting any adverse influence upon the amount of fuel injected, even when the timer is operated.

This object of the present invention can be achieved by a fuel injection pump of the distributor type comprising: a pump head provided with a pump chamber therein into which fuel is to be fed, at least one pump plunger arranged in the pump head which reciprocates to pressurize the fuel in the pump chamber, a driving shaft which rotates in synchronism with the engine, converter means for reciprocating the pump plunger by the rotation of the driving shaft, which is provided with an adjusting member which encloses the driving shaft, and which can rotate in phase around the axis of the driving shaft to adjust the pressure timing of the fuel in the pump chamber in relation to the rotary phase angle of the driving shaft, timer means for adjusting the angle of the rotated and shifted adjusting member of the converter means, depending upon the operation of the engine, means for distributing and feeding successively into each of cylinders of the engine the fuel in the pump chamber which has been pressurized by the pump plunger, means for adjusting the amount of pressurized fuel to be fed to each of the engine cylinders which allows the fuel, which is pressurized in the pump chamber in the pump head and fed the engine cylinder, to escape at a predetermined timing, a plurality of portions located on the outer circumference of the driving shaft for detecting the rotary angle of the driving shaft, sensor means for detecting the to-be-detected portions of the driving shaft and then generating signals which represent the rotary angles of the driving shaft, which is provided with a sensor fixed to the adjusting member of the converter means, and control means for detecting the fuel pressure starting time on the basis of the signals supplied from the sensor means, and for rendering the fuel escaping means operative after the predetermined delay time since the fuel pressure starting time has elapsed.

According to the present invention, the sensor of the sensor means is attached to the adjusting member of the converter means. Therefore, even if the timer means operates and adjusts the rotational angle of the adjusting member in dependent upon the operation of the engine, the sensor is also rotated and shifted around the axis of the driving shaft together with the adjusting member. Thus, no discrepancy is caused in the phase angle between the sensor of the sensor means and the to-be-detected portions as viewed from the direction of the axis of the driving shaft. No matter what state the engine is in, the actual fuel pressure starting time in the pump chamber can be correctly detected by the sensor means and the detected portions. As a result, the fuel escaping means can be operated at a desired timing, and the amount of fuel fed by the fuel injection pump can be therefore controlled with high accuracy, no matter what state the engine is in.

DETAILED DESCRIPTION OF THE PREFERRED EMBODIMENTS

Figure 1:
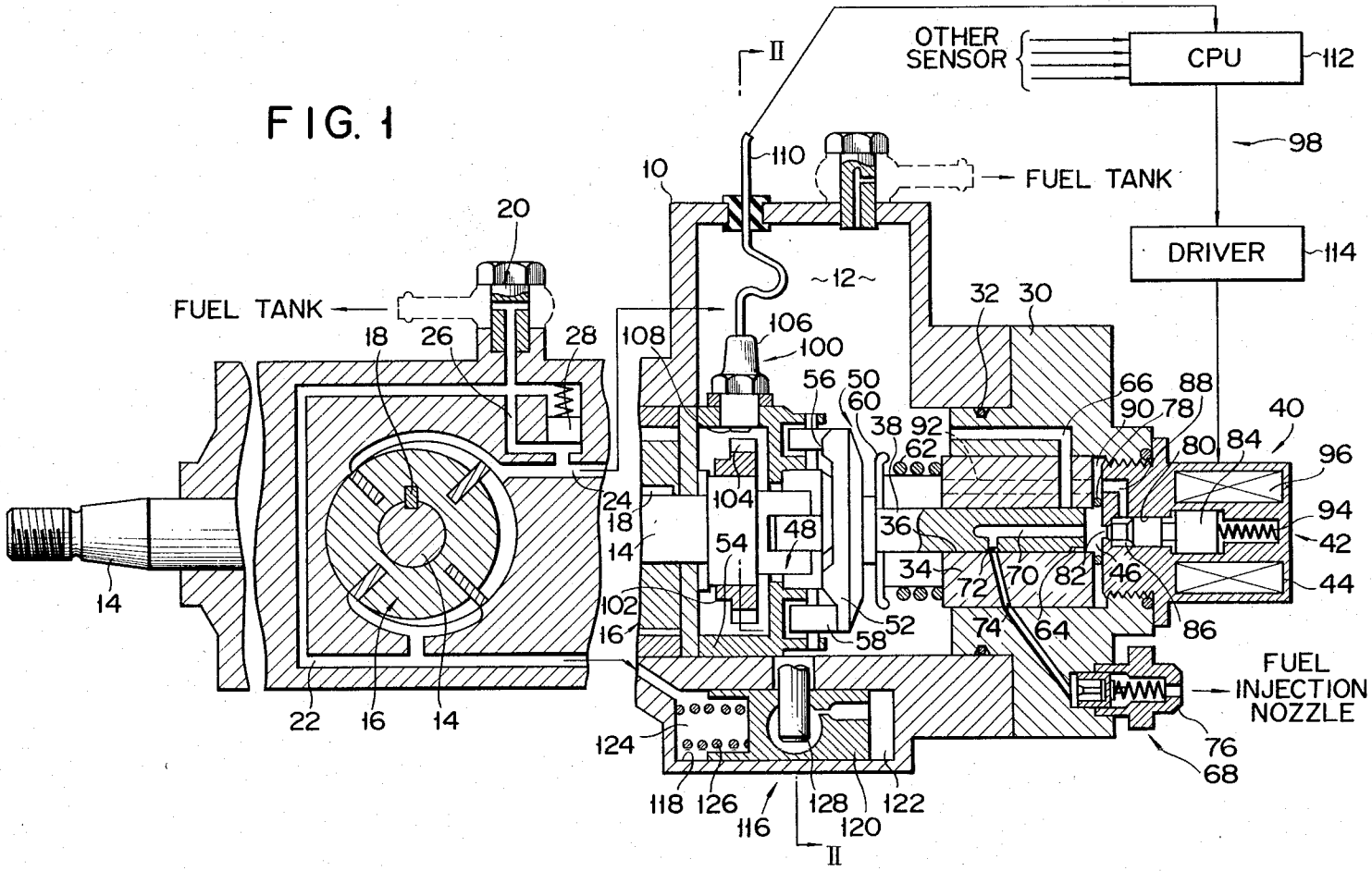
FIG. 1 is a sectional view showing an example of the distributor type fuel injection pump according to the present invention.

FIG. 1 shows an example of the distributor type fuel injection pump according to the present invention. This fuel injection pump includes a pump housing 10 in which a fuel supply chamber 12 is defined.

A pump shaft 14 which serves as a driving shaft is supported to be freely rotatable in the pump housing 10. The pump shaft 14 extends at one end thereof into the fuel supply chamber 12 while it projects at the other end thereof outside the pump housing 10. The other end of the pump shaft 14 which projects from the pump housing 10 is connected to an engine (not shown) through a power transmitting mechanism (not shown), thereby enabling the pump shaft 14 to rotate in synchronism with the engine.

Further, a feed pump 16 which serves to supply fuel to the fuel supply chamber 12 is arranged in the pump housing 10. This feed pump 16 is of a vane type, for example, and is attached to the pump shaft 14 through a key 18. In short, the pump shaft 14 is common to the fuel injection pump and the feed pump. Therefore, when the feed pump 16 is driven by the engine, fuel is introduced from a fuel tank to a fuel sucking portion 20 of the pump housing 10, from which it is further introduced to the feed pump 16, after passing through a pump inlet passage 22 defined in the pump housing 10. The fuel introduced to the feed pump 16 is pressurized by the feed pump 16 and is then fed into the fuel supply chamber 12, after passing through a pump outlet passage 24 defined in the pump housing 10. The pump inlet and outlet passages are communicated with each other by a bypass passage 26 which bypasses the feed pump 16. An adjusting valve 28 is arranged in the bypass 26 to adjust the pressure of the fuel fed from the feed pump 16. Therefore, the pressure of the fuel in the fuel supply chamber 12 is adjusted to a predetermined value set by the adjusting valve 28. In FIG. 1, the part which represents the feed pump 16 and is different from the other two is shown as a sectional view taken along a plane which is perpendicular to the plane along the axis of the pump shaft 14 for the sake of clarifying the feed pump 16.

A pump head 30 is liquid-tightly fixed via an O-ring 32 to the end of said pump housing 10 which is the farthest from the feed pump 16. A cylinder portion 34 is fitted into the pump head 30, and a cylinder hole 36 is penetrated through the cylinder portion 34, extending coaxially with the axis of the pump shaft 14. A pump plunger 38 is fitted through the cylinder hole 36 in such a way that it can freely rotate and freely reciprocate in the axial direction of the cylinder hole 36. A pump chamber 46 in the cylinder hole 36 is defined by one end of the pump plunger 38 and a valve housing 44 of an electromagnetic valve 42 of an adjusting mechanism 40, which will be described later. The other end of the pump plunger 38 extends into the fuel supply chamber 12 to be connected to the other end of the pump shaft 14 via a coupling 48, which is roughly shown in FIG. 1, but which serves to integrally rotate the pump shaft 14 and the pump plunger 38 while allowing the pump plunger 38 to reciprocate in its axial direction. Therefore, the pump plunger 38 is rotated to follow the rotation of the pump shaft 14.

Further, arranged on the other end of the pump plunger 38 is a converter mechanism 50 for reciprocating the pump plunger 38 by the rotation of the pump shaft 14. This converter mechanism 50 includes a face cam 52 and a roller ring 54. The face cam 52 is mounted on the other end of the pump plunger 38. The end of the face cam 52 which is adjacent to the pump shaft 14 has a surface 56 with a series of indentations along its circumference. As apparent from FIG. 2, the roller ring 54 is supported to be freely rotatable around the axis of the driving shaft 14 along the inner face of the pump housing 10. A plurality of rollers 58 is attached to the circumference of the end of the roller ring 54 which is adjacent to the face cam 52, with an equal interval interposed between the rollers 58. These rollers 58 are rotatably contacted with the cam surface 56 of the face cam 52. The contact between the rollers 58 and the cam surface 56 can be held by urging the pump plunger 38 toward the pump shaft 14 by means of a coil spring 62 which is located between a spring seat 60 fixed to the pump plunger 38 and the other end face of the cylinder portion 34. According to this converter mechanism 50, the face cam 52 is rotated following the rotation of the pump plunger 62 while its surface 56 remains in contact with the rollers 58 on the roller ring 54. Therefore, the pump plunger 38, along with face cam 52, is reciprocated with a predetermined stroke in the axial direction thereof while it rotates. It should be noted that the pump plunger 38 is reciprocated the same number of times as is the number of cylinders in the engine per one revolution.

Fuel sucking grooves 64 are formed equidistantly, on the outer circumference of one end of the pump plunger 38 to communicate with the pump chamber 46. The number of sucking grooves 64 is equal to the number of cylinders in the engine. Each of the sucking grooves 64 is adapted to communicate with the end of a fuel sucking passage 66 formed in the cylinder portion 43 and pump head 30, when the pump plunger 38 reaches its predetermined rotary angles. The other end of the sucking passage 66 is usually communicated with the fuel supply chamber 12. To describe in more detail the conditions under which each of the sucking grooves 64 on the pump plunger 38 communicates with the sucking passage 66, the pump plunger 38 never fails to be moved in the direction which increases the volume of the pump chamber 46, that is, in the left direction in FIG. 1. Under this state, therefore, the fuel in the fuel supply chamber 12 is introduced into the pump chamber 46 through the sucking passage 66 and one of the sucking grooves 64 on the pump plunger 38. This is called the fuel sucking process in the fuel injecting pump. When the pump plunger 38 is then moved in the direction which reduces the volume of the pump chamber 46, that is, in the right direction in FIG. 1, communication between the sucking grooves 64 and the sucking passage 66 which was established is shut off by the rotation of the pump plunger 38. When the pump plunger 38 starts moving toward the right direction in FIG. 1, therefore, the fuel in the pump chamber 46 also starts to be pressurized. This state is called the fuel pressuring process in the fuel injecting pump.

When the fuel in the pump chamber 46 is pressurized as described above, it is distributed and fed to each of the cylinders of the engine. A fuel distributing and deliverying mechanism 68 will be described below. This fuel distributing and deliverying mechanism 68 is provided with a communication passage 70 formed in the pump plunger 38. The communication passage 70 extends along the axial direction of the pump plunger 38 and is communicated with the pump chamber 46 at one end thereof. On the other hand, a distributing groove 72 is formed at the outer circumference and in the center of the pump plunger 38. This fuel distributing groove 72 is communicated with the other end portion of the communication passage 70. The fuel distributing groove 72 can be communicated with one of several delivery passages 74 formed in the cylinder portion 34 and pump head 30 when the pump plunger 38 is in the above-described pressurizing process and reaches one of its predetermined rotary angles. More specifically, one end of the delivery passages 74 is opened at the inner circumference of the cylinder hole 36 of the cylinder portion 34. These openings on the delivery passages 74 are located on the inner circumference of the cylinder hole 36, with an equal interval interposed between them. Needless to say, the number of delivery passages 74 is the same as the number of cylinders in the engine. Connected to the other ends of the delivery passages 74 are delivery valves 76, each of which is located on the outer end face of the pump head 30, as shown in FIG. 1.

According to the fuel distributing and deliverying mechanism as described above, the fuel distributing groove 72 is communicated with one of the delivery passages 74 after the elapse of a predetermined time since the fuel is pressurized in the pump chamber. The pressurized fuel in the pump chamber 46 is fed at this time to the fuel injection nozzle of a predetermined cylinder in the engine, passing through the communication passage 70, distributing groove 72, delivery passage 74 and delivery valve 76 which is connected to the delivery passage 74. Then the pressurized fuel is injected into the combustion chamber in the cylinder through the fuel injecting nozzle. This state is called the fuel delivery process in the fuel injecting pump. As apparent from the rotation and reciprocation of the pump plunger 38, the fuel delivery process is repeated the same number of times as the number of cylinders in the engine per one revolution of the pump plunger 38, thereby enabling the pressurized fuel to be successively delivered from the fuel injecting pump to each of the cylinders of the engine.

This example of the fuel injection pump according to the present invention is provided with the fuel amount adjusting mechanism 40 for adjusting the amount of the pressurized fuel delivered to each of the cylinders in the engine. This fuel amount adjusting mechanism 40 has an electromagnetic valve 42 which is attached to the outer end face of the pump head 30, as shown in FIG. 1. More specifically, the valve housing 44 for the electromagnetic valve 42 is fixed to the outer end face of the pump head 30 in such a way that it is screwed into the pump head 30 at one end. When the valve housing 44 is screwed into the pump head 30, an O-ring 78 is sandwiched between one end of the cylinder portion 34 and the end of the valve housing 44 which has been screwed into the pump head 30, as shown in FIG. 1. The pump chamber 46 is thus actually defined by the inner wall of the cylinder hole 36, one end of the pump plunger 38, the end face of the valve housing 44 which faces this the end of the pump plunger 38, and the O-ring 78. A stepped hole 80 which is coaxial with the axis of the pump plunger 38 is formed in the valve housing 44. The stepped hole 80 is closed at one end but is opened at the pump chamber 46 at the other end. That portion of the stepped hole 80 which is opened at the pump chamber 46 has a smaller diameter and serves as a valve hole 82. On the other hand, a stepped valve plunger 84 of the needle type is fitted into the stepped hole 80 to freely slide in its axial direction so as to close and open the valve hole 82. That portion of the valve plunger 84 which is located on the side of the valve hole 82 has a diameter smaller than that of the stepped hole 80, thereby defining an annular chamber 86 around that portion of the valve plunger 84. The annular chamber 86 is communicated with a spillway 88 formed in the valve housing 44. The spillway 88 is communicated with an annular chamber 90 which is formed between the valve housing 44 and the cylinder portion 34 and which is defined by the O-ring 78. The annular chamber 90 is also communicated with fuel supply chamber 12 through a spillway 92 formed in the cylinder portion 34. More specifically, the passage which allows the fuel to escape from the pump chamber 46 includes the valve hole 82, annular chamber 86, spillway 88, annular chamber 90 and spillway 92, as is apparent from the above.

A valve spring 94 is housed in the right-hand portion of the stepped hole 80 in the valve housing 44. The valve plunger 84 is urged by the valve spring 94 to be in the closed position over the valve hole 82. Namely, the electromagnetic valve 42 is usually closed. Further, a solenoid coil 96 is housed in the valve housing 44, enclosing one end portion of the valve plunger 84. When this solenoid coil is energized, the valve plunger 84 is moved towards the right as in FIG. 1 to open the valve hole 82.

Before describing the control mechanism 98 for controlling the operation of the electromagnetic valve 42, there will be described a detector mechanism 100 for detecting the time at which the fuel pressuring process should be started. In this embodiment, the detector mechanism 100 is adapted to detect the time at which the fuel pressuring process is started or when the fuel in the pump chamber 46 starts to be pressurized on the basis of the rotary angles of the pump plunger 38. More specifically, a pulser ring 102 is fixed to that portion of the pump shaft 14 which is enclosed by the roller ring 54 of the converter mechanism 50, and is rotated to be integral with the pump shaft 14. A plurality of pulser projections 104 is radially projected to be equidistant from the circumference of the pulser ring 102. The number of pulser projections 104 is the same as the number of cylinders in the engine. On the other hand, a sensor 106 is fixed to the roller ring 54. A detecting portion 108 of the sensor 106 is projected from the inner circumference of the roller ring 54 and can be opposite the pulser projections 104 of the pulser ring 102.

The sensor 106 generates a pulse signal every time one of the pulser projections 104 passes just under the detecting portion 108 of the sensor 106, following the rotation of the pulser ring 102. The sensor of the electromagnetic converter type such as the electromagnetic pickup, for example, is used as the sensor 106, but it is not limited to this. The well-known Hall element, optical angle detector or the like may also be used.

The most important matter upon arranging the pulser projections 104 of the pulser ring 102 and the sensor 106 is that each pulser projection 104 be positioned just under the detecting portion 108 of the sensor 106 when the fuel pressurizing process is started or when the pump plunger 38 is moved from dead center to the right as shown in FIG. 1 during its one rotation.

The pulse signals generated by the sensor 106 are transmitted to the control mechanism 98 through a signal path 110. The control mechanism 98 has a central processing unit (CPU) 112 to which the pulse signals from the sensor 106 are applied. Also applied to the CPU 112 are sensor signals from various kinds of sensors for detecting the rotating speed of engine, the degree to which the acceleration pedal has been depressed, the temperature of the engine coolant, and so on. The CPU 112 processes the pulse signals applied from the sensor 106 as well as the sensor signals applied from the above-cited other sensors, and generates a control signal to open the electromagnetic valve 42 after the elapse of a predetermined delay time after the fuel has been pressurized. More specifically, when the control signal is supplied from the CPU 112 to a driver 114 which serves to drive the electromagnetic valve 42, the solenoid coil 96 of the electromagnetic valve 42 is energized to open the electromagnetic valve 42. According to the control and detector mechanisms as described above, therefore, the timing at which the control signal is outputted from the CPU 112 or the timing at which the electromagnet valve 42 is opened depends upon the operation of the engine. When the fuel injection pump is distributing and deliverying fuel, the pressurized fuel which is to be delivered from the pump chamber 46 to the cylinder in the engine must be able to escape to the fuel supply chamber 12 through the escaping passages 82, 86, 88, 90 and 92. In this ways, the amount of pressurized fuel, which is delivered from the fuel injection pump to each of the cylinders in the engine, can be adjusted to a predetermined value.

Figure 2:
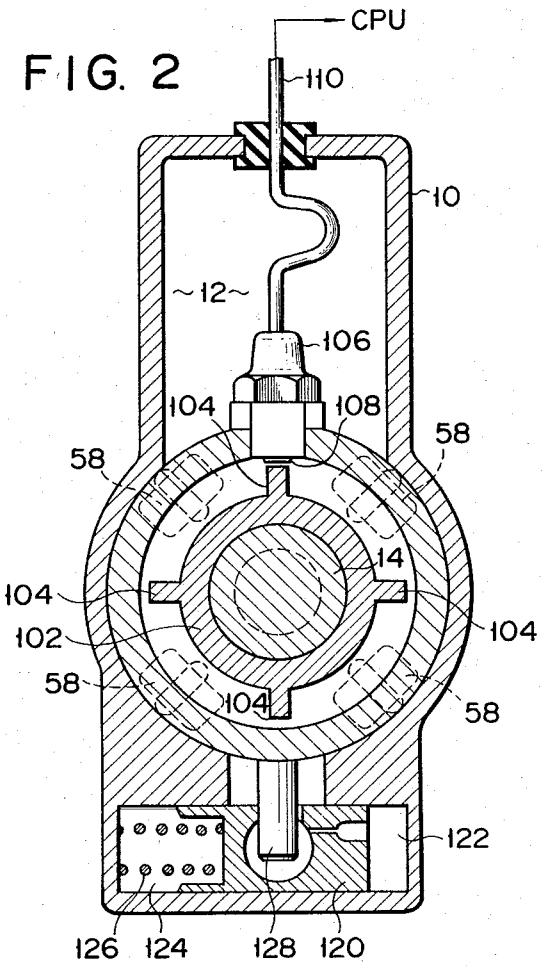
FIG. 2 is a sectional view taken along the line II—II in FIG. 1.

The timer mechanism 116 which is usually employed in the fuel injection pump will be described below. In the case of this example of the fuel injection pump according to the present invention, the timer mechanism 116 is of a hydraulic type. A cylinder hole 118 for the timer is defined at the lower portion of the pump housing 10 in FIG. 1. The cylinder hole 118, as shown in FIG. 1, extends parallel to the axis of the pump shaft 14 for the sake of convenience. However, it actually extends perpendicular to the axis of the pump shaft 14, as shown in FIG. 2. A timer piston 120 is fitted to be freely slidable in the cylinder hole 118, and a liquid-tight chamber 122 and a spring housing chamber 124 are formed on both sides of the timer piston 120 in the cylinder hole 118. The fuel in the fuel supply chamber 12 is introduced into the liquid-tight chamber 122 through a passage (not shown). Namely, the pressure of the fuel in the fuel supply chamber 12 acts on the end of the timer piston 120 which defines the liquid-tight chamber 122. A timer spring 126 is housed in the spring housing chamber 124. The timer spring 126 urges the timer piston 120 toward the liquid-tight chamber 122. As shown in FIG. 1, the spring housing chamber 124 is communicated with the sucking passage 22 to introduce the fuel from the fuel tank into the spring housing chamber 124. The timer piston 120 is connected to the roller ring 54 of the converter mechanism 50 by means of a connector pin 18, as shown in FIGS. 1 and 2.

According to the timer mechanism 116 as described above, therefore, the fuel pressure in the liquid-tight chamber 122 or fuel supply chamber 12 which changes depending upon the rotating speed of the engine acts on one end of the timer piston 120 to displace this timer piston 120 in its axial direction. The displacement of this timer piston 120 rotates and shifts the roller ring 54 of the converter mechanism 50 through the connector pin 128 around the axis of the pump shaft 14. When the roller ring 54 is rotated and shifted in this manner, the reciprocating timing of the pump plunger 38, which is forced to reciprocate through the contact between the face cam 52 and the rollers 58 of the roller ring 54 is shifted. The fuel pressuring timing is also shifted accordingly, so that the timing at which the fuel is delivered from the fuel injection pump (or fuel injecting timing) varies according to the rotating speed of the engine. In other words, the fuel injection timing of the fuel injection pump can be either advanced or delayed according to the engine's rotation speed by using the timer mechanism 116.

Figures 3, 4, 5:
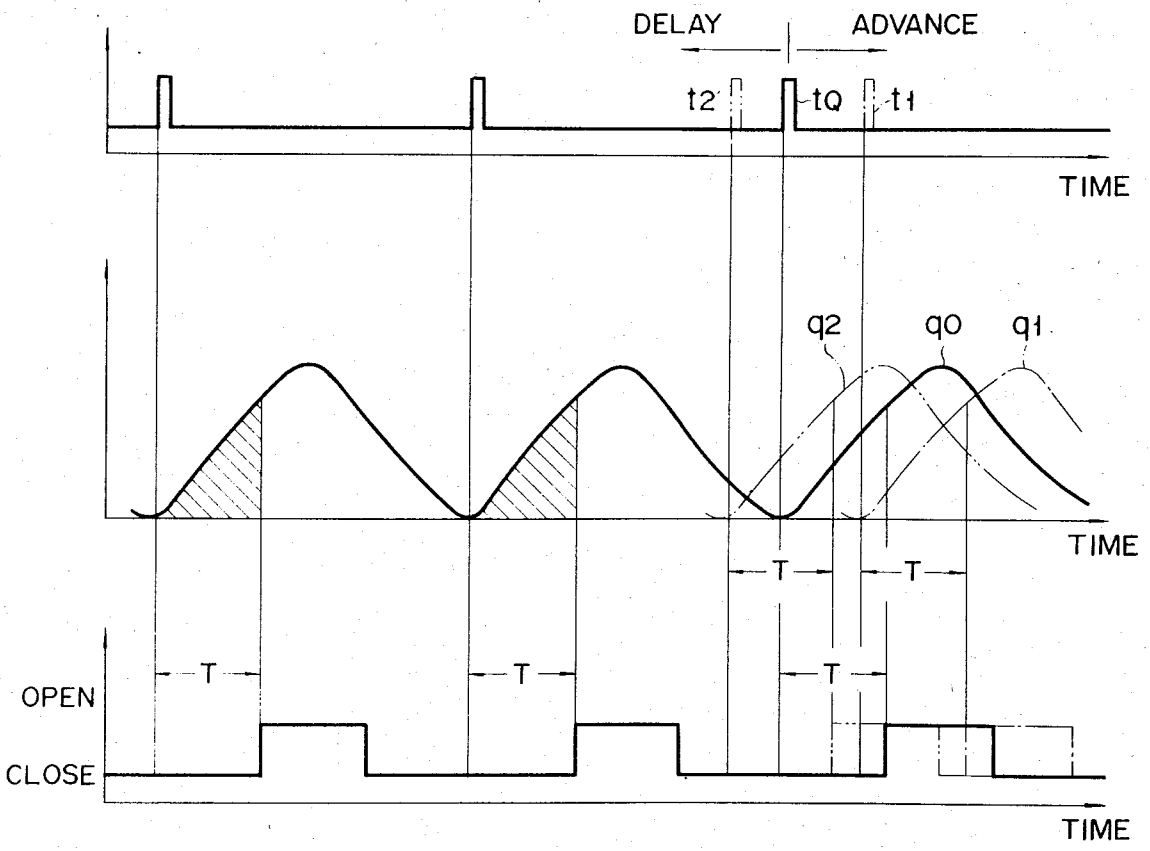
FIG. 3 is a view showing the characteristics of a pulse signal applied from the sensor means.
FIG. 4 is a view showing the characteristics of the fuel derivery ratio achieved by the fuel injection pump.
FIG. 5 is a view showing the operation of opening and closing the electromagnetic valve.

The operation of the fuel injection pump according to the present invention will be described as a combination of the operation of the timer mechanism 116 and that of the fuel amount adjusting mechanism 40, with reference to FIGS. 3 through 5. Referring to FIG. 3 first, the output characteristic of the pulse signal applied from the sensor 106 is shown. The characteristic of the fuel deliverying ratio of one fuel distributing and deliverying process is roughly shown in FIG. 4. The fuel deliverying ratio represents the amount of fuel delivered per each predetermined travel unit of the pump plunger 38. FIG. 5 shows the operation characteristics of the electromagnetic valve 42.

Considering FIGS. 3 through 5 as a whole, it is apparent that the amount Q of pressurized fuel delivered from the fuel injection pump can be represented by the hatched area in FIG. 4 when the electromagnetic valve 42 is opened after the elaspe of a predetermined time T or after the pulse signal has been applied from the sensor 106. Provided that the engine rotation speed shows no change, that the operation of the timer mechanism 116 does not change accordingly, and that no change is found in the other conditions, it is apparent that the amount of fuel delivered from the fuel injection pump can also be represented by the same amount Q.

When, however, the operation of the timer mechanism 116 changes because of an increase or decrease in the engine rotation speed, the characteristic of the fuel deliverying ratio is changed from q0 to q1 as represented by a dot-and-dash line in FIG. 4, and to q2 as represented by a two-dot-and-dash line, thereby allowing the fuel injection timing to be accelerated or delayed. In this case, however, the timing at which the pulse signal is applied from the sensor 106 is also changed from t0 to t1 or t2, as shown in FIG. 3, following the change in the fuel deliverying ratio characteristic, since the sensor 106 is fixed to the roller ring 54 of the converter mechanism 50. Namely, the timing of pulse signal applied from the sensor 106 coincides with the time at which the fuel is pressurized, whatever change the operation of the timer mechanism 116 may show. Since the timing at which the electromagnetic valve 42 is opened is set after a predetermined delay time T has elapsed and after a pulse signal from the sensor 106 occurs as described above, the amount of fuel to be delivered is determined only by the delay time T, as is apparent from FIGS. 2 and 3, whatever change the operation of the timer mechanism 116 may show. As a result, the amount of fuel to be delivered can be adjusted with high accuracy, without being influenced by any change in the operation of the timer mechanism 116.

Figure 6:
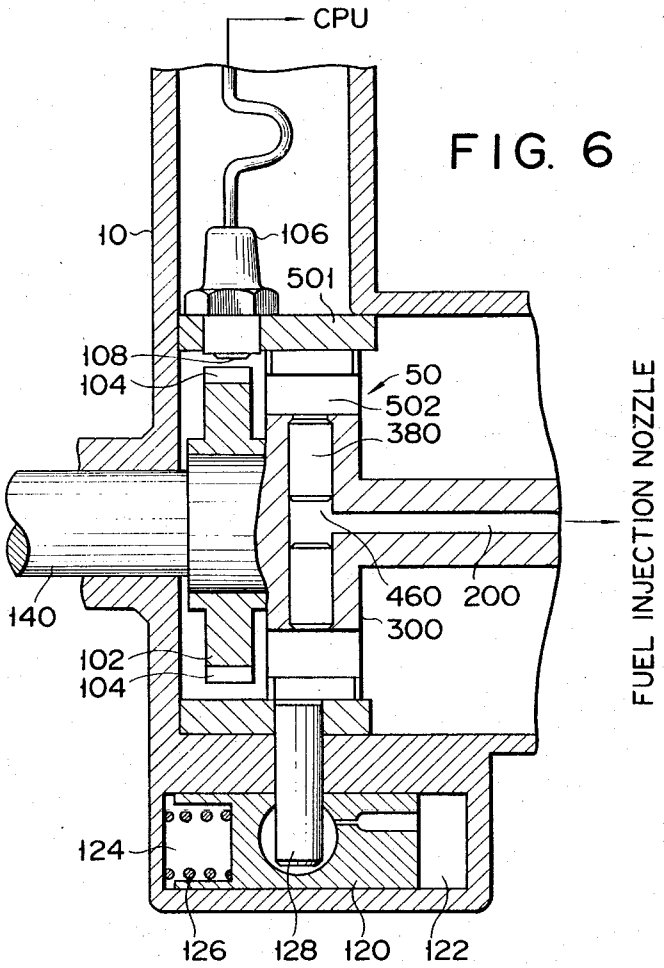
FIG. 6 is a partial section showing another example of the distributor type fuel injection pump according to the present invention.

It should be understood that the present invention is not limited to the above-described example of a fuel injection pump. FIG. 6 shows another example in which the present invention has been applied to a fuel injection pump of another type. The same parts as those of the fuel injection pump shown in FIGS. 1 and 2 will be represented by the same reference numerals, and a description of these parts will be omitted upon describing the fuel injection pump shown in FIG. 6. A pump shaft 140 of the fuel injection pump shown in FIG. 6 only performs rotation. A disc-shaped pump head 300 is formed to be integral to the pump shaft 140. A pair of pump plungers 380 are fitted in the pump head 300 to freely reciprocate in a direction perpendicular to the axis of the pump shaft 140. A pump chamber 460 is defined between the pump plungers 380 in this case. The pump chamber 460 is communicated with a passage 200 which is formed in the pump shaft 140 to serve as a fuel sucking and deliverying passage. The other end of the passage 200 is connected to the fuel sucking and distributing mechanisms (not shown).

In the case of the fuel injection pump shown in FIG. 6, the converter mechanism 50 has a cam ring 501 and a cam follower 502. The cam ring 501 is arranged in the pump housing 10, enclosing the pump head 300. The cam ring 501 is supported in the pump housing 10 so as to freely rotate around the axis of the pump shaft 140. The inner circumference of the cam ring 501 is formed as a cam face. The cam follower 502 has rollers 503 which contact in a sliding way the cam face of the cam ring 501. The cam follower 502 is contacted by the pump plungers 380, respectively, in such a way that it is held freely slidable in the pump head 300 in the direction in which the pump plungers 380 are slided.

Even if the converter mechanism 50 has the arrangement as described above, the pump plungers 380 are reciprocated due to the action between the cam face of the cam ring 501 and the cam follower 502 when the pump shaft 140 or pump head 300 is rotated, thereby enabling the fuel sucking and distributing and deliverying processes to be achieved. This function is conventionally well known.

In the case of the fuel injection pump shown in FIG. 6, a sensor 106 is fixed to the cam ring 501. On the other hand, the connector pin 128 of the timer mechanism 116 is also connected to the cam ring 501.

Even if the fuel injection pump shown in FIG. 6 has the arrangement as described above, it will be apparent that the amount of fuel delivered can be adjusted with high accuracy, as is similar to the case of the one shown in FIGS. 1 and 2, whatever change the operation of the timer mechanism 116 may show.

Although the hydraulic timer has been employed as a timer mechanism in the above-described embodiments, there may also be employed the hydraulic timer of the servo-piston type, or an electronic control timer which controls fluid pressure of the liquid-tight chamber 122 using an electromagnetic valve.

What is claimed is:

1. A fuel injection pump of the distributor type for delivering fuel to cylinders in an internal combustion engine comprising:

a pump head provided with a pump chamber therein into which fuel is to be fed;

at least one pump plunger arranged in the pump head which reciprocates to pressurize the fuel in the pump chamber in the pump head;

a driving shaft which rotates in synchronism with the engine;

converter means for reciprocating the pump plunger by the rotation of the driving shaft to pressurize the fuel in the pump chamber, and provided with an adjusting member for enclosing the driving shaft and which is rotatingly shifted around the axis of the driving shaft to adjust a timer at which the fuel in the pump chamber is pressurized in relation to the rotary phase angle of the driving shaft;

timer means for adjusting the angle of the rotatingly shifted adjusting member of the converter means, depending upon the operation of the engine;

means for distributing and deliverying successively into each of the cylinders in the engine the fuel in the pump chamber which has been pressurized by the pump plunger;

adjusting means for adjusting the amount of pressurized fuel delivered to each of the cylinders in the engine by allowing, at a predetermined timing, the fuel which is to be pressurized in and delivered from the pump chamber in the pump head to escape;

a plurality of to-be-detected portions located on the outer circumference of the driving shaft used to detect the rotary angle of the driving shaft;

sensor means for detecting the to-be-detected portions on the driving shaft and then generating signals which represent the rotary angles of the driving shaft, which is provided with a sensor fixed to the adjusting member of the converting means; and control means for detecting the fuel pressure starting time on the basis of the signals supplied from the sensor means and for rendering the fuel amount adjusting means operative after the elapse of a predetermined delay time after the fuel has been pressurized.

2. A fuel injection pump according to claim 1, wherein the converter means includes a coupling for connecting the pump plunger to the driving shaft in such a way that the pump plunger can be reciprocated in the axial direction of the driving shaft and that the pump plunger can be rotated together with the driving shaft, a ring member located coaxially enclosing the driving shaft to serve as the adjusting member and provided with a plurality of cam rollers, and a face cam attached to the pump plunger and having a cam surface which is contacted with the rollers of the ring member to convert the rotation of the driving shaft to the reciprocation of the pump plunger.

3. A fuel injection pump according to claim 1, wherein the pump head is coaxial with the axis of the driving shaft, is rotatable together with the driving shaft, and is provided with the pump plungers which can be reciprocated in a direction perpendicular to the axis of the driving shaft; the converter means includes a ring member located coaxially with the axis of the driving shaft enclosing the pump head to serve as the adjusting member; the inner circumference of the ring member is formed as a cam surface for converting the rotation of the pump head to reciprocate with the pump plungers; and each of cam follower which is located between each of the pump plungers of the pump head and the ring member, and which is reciprocal together with its corresponding pump plunger in the axial direction thereof holds a cam roller which is in sliding contact with the cam surface of the ring member.

4. A fuel injection pump according to claim 1, wherein the sensor means includes a sensor of the electromagnetic transducer type attached to the adjusting member and facing the outer circumference of the driving shaft, and the to-be-detected portions are pulser projections located on the outer circumference of the driving shaft, each projection being equidistant, and a pulse signal which is generated every time one of the pulser projections passes just under the sensor.

5. A fuel injection pump according to claim 4, wherein the number of the pulser projections is the same as the number of cylinders in the engine.

6. A fuel injection pump according to claim 1, wherein the adjusting means includes a fuel escaping passage communicated with the pump chamber of the pump head, and an electromagnetic valve arranged in the fuel escaping passage to open and close the fuel escaping passage.

7. A fuel injection pump according to claim 1, wherein the adjusting means includes a fuel escaping passage communicated with the pump chamber of the pump head, and an electromagnetic valve arranged in the fuel escaping passage to open and close the fuel escaping passage wherein the control means includes an electronic circuit for receiving the sensor signal applied from the sensor means to control the operation of the electromagnetic valve.

8. A fuel injecting pump according to claim 7, wherein the electronic circuit has a central processing unit to which a sensor signal is applied from the sensor means and to which other signals are also applied from various kinds of sensors for detecting the operation of the engine.

9. A fuel injection pump according to claim 1, wherein the timer means includes a timer cylinder which contains a timer piston which is fitted to be freely slidable depending upon the operation of the engine, and a connector member for connecting the timer piston to the adjusting member and for transmitting the movement and shift of the timer piston to the adjusting member to rotate and shift the adjusting member around the axis of the driving shaft.

10. A fuel injection pump according to claim 9, wherein the timer pistion is moved in the timer cylinder by means of a pressurized liquid which changes its pressure depending upon the operation of the engine.

11. A fuel injection pump according to claim 10, wherein the pressurized liquid is pressurized fuel which is supplied to the pump chamber in the pump head by means of a feed pump which is driven by the driving shaft.

* * * * *